United States Patent [19]

Perucca

[11] 4,023,662

[45] May 17, 1977

[54] ARRANGEMENT FOR ADJUSTING THE SPACING BETWEEN A PRINT HEAD AND A PLATEN

[75] Inventor: Vincenzo Perucca, Ivrea (Turin), Italy

[73] Assignee: Ing. C. Olivetti & C., S.p.A., Ivrea (Turin), Italy

[22] Filed: Oct. 30, 1975

[21] Appl. No.: 627,263

[30] Foreign Application Priority Data

Dec. 20, 1974 Italy ..... 70705/74
Dec. 19, 1974 Italy ..... 70681/74

[52] U.S. Cl. ..... 197/1 R; 346/139 A
[51] Int. Cl.[2] ..... B41J 3/50
[58] Field of Search ..... 197/1 R, 149; 346/139 A

[56] References Cited

UNITED STATES PATENTS

| | | | |
|---|---|---|---|
| 3,442,210 | 5/1969 | Hawxhurst | 197/149 X |
| 3,750,792 | 8/1973 | Liles | 197/1 R |
| 3,817,365 | 6/1974 | Zimmermann | 197/1 R |
| 3,910,395 | 10/1975 | Colglazier et al. | 197/1 R |
| 3,912,068 | 10/1975 | Kwan et al. | 197/1 R X |
| 3,935,936 | 2/1976 | Wilczewski | 197/1 R |
| 3,951,252 | 4/1976 | Selke et al. | 197/1 R X |

*Primary Examiner*—Ernest T. Wright, Jr.

[57] ABSTRACT

A device for adjusting the distance of a printing head from a platen for an office machine comprises a printing head movable parallel to a platen along two guides. One of these guides is fixed to the frame of the machine; the other is transversely shiftable by a cam for correspondingly shifting the head, the cam being swung by a manually operable linkage. The device further comprises means for preventing the driving belt from excessive stresses and wear.

7 Claims, 4 Drawing Figures

ARRANGEMENT FOR ADJUSTING THE SPACING BETWEEN A PRINT HEAD AND A PLATEN

BACKGROUND OF THE INVENTION

1. Field of the Invention

The present invention relates to an office machine with an arrangement for adjusting the spacing of a printing head from a platen as a function of the number of copies of the original that are being made, the head being a wire-type head.

2. Description of the Prior Art

Devices for adjusting the distance of the printing head from the platen are known; in particular, an adjusting device is mounted on a carriage and can be shifted in a direction perpendicular to the axis of the platen. In the rear part of the carriage (the part facing the platen), there is pivoted a pulley which rolls on a flat auxiliary guide fixed to the frame of the machine. On the auxiliary guide there are placed strips of a thickness equal to the total thickness of the sheets placed around the platen, so that when the pulley rolls thereon the head is moved away from the platen by an amount exactly equal to the thickness of the sheets on which it is desired to print. As can be seen, such an adjustment of the distance of the head from the platen is very complicated and requires a long time for the setting up.

There is known a printer wherein the printing heat is slidable on guides movable perpendicularly with respect to the platen and wherein the transporting element for the head is constituted by a belt driven by a motor and connected directly to the head. When the guides are shifted, the belt bends transversely to accommodate the perpendicular adjustments of the head.

This arrangement, however, has the disadvantage that owing to the perpendicular movements of the head, the driving belt is stressed by considerable forces at the beginning and at the end of printing operations, and the belt is therefore liable to wear out very quickly. Moreover, as regards construction, the free length of the belt is necessarily greater than the length of the printing line.

SUMMARY OF THE INVENTION

In office machines employing a printing head of the wire type, the distance between the head and the platen is of critical importance inasmuch as the stroke of each printing wire of the head is constant and well defined. In fact, the stroke of each printing wire is rather short, generally of the order of a few tenths of a millimeter and therefore, assuming the position of the platen to be fixed, in the event of variation of the thickness of the recording medium or of a variation in the number of copies being taken as carbons, the head must shift further away from or closer to the platen to adapt itself to such variations. In other words, the printing head must be placed at a fixed, predetermined distance from the top surface of the paper on which printing is to be carried out.

More particularly, when it is desired to print also a plurality of copies in addition to the original, it is necessary to vary the distance of the head from the platen in dependence upon the number of copy sheets inserted in the machine, so that the distance between the head and the top copy sheet may remain unchanged.

It is an object of the present invention to provide an office machine comprising a platen, a wire-type head as hereinbefore defined movable parallel to the platen along at least one guide, and a manually operable arrangement for selecting the distance of the head from the platen, comprising a cam on a shaft parallel to the guide, which shaft can shift transversely with respect to the axis of the platen and is engaged with the head so as correspondingly to shift the head, a manually operable linkage for swinging the cam about the axis of the shaft, and means co-operating with the cam for shifting the shaft in response to the swinging of the cam.

Another object of the present invention is to provide an improved arrangement which prevents the belt from excessive stress and wear.

BRIEF DESCRIPTION OF THE DRAWING

The invention will be described in more detail, by way of example, with reference to the accompanying drawing, in which.

DETAILED DESCRIPTION OF THE INVENTION

Figure 1:
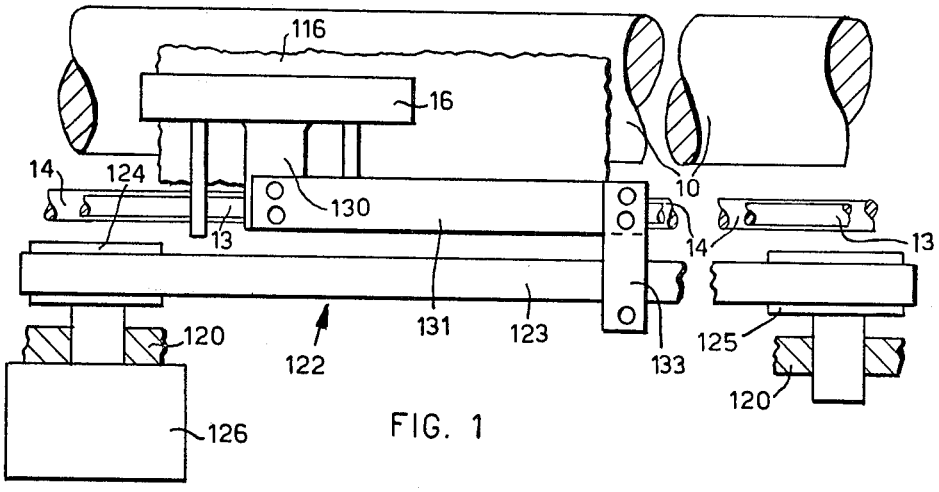
FIG. 1 is a front view, partly in section, of the arrangement embodying the invention.
Figure 2:
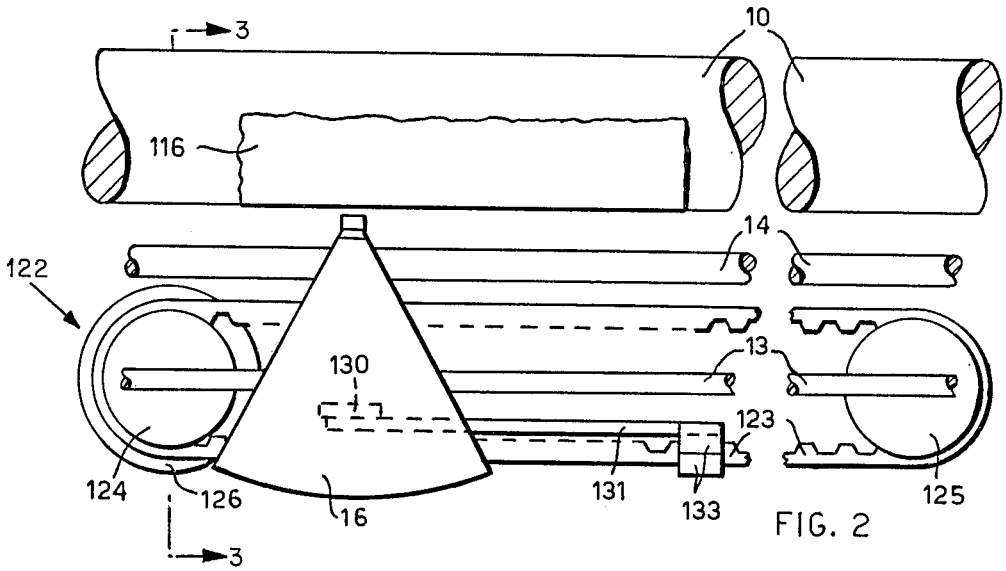
FIG. 2 is a plan view, partly in section, of the arrangement.
Figure 3:
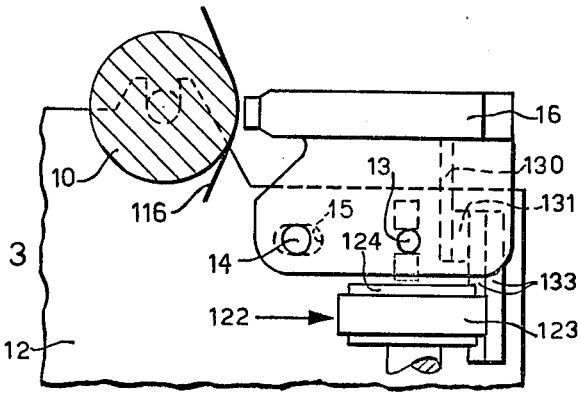
FIG. 3 is a section taken along the line 3—3 of FIG. 2.
Figure 4:
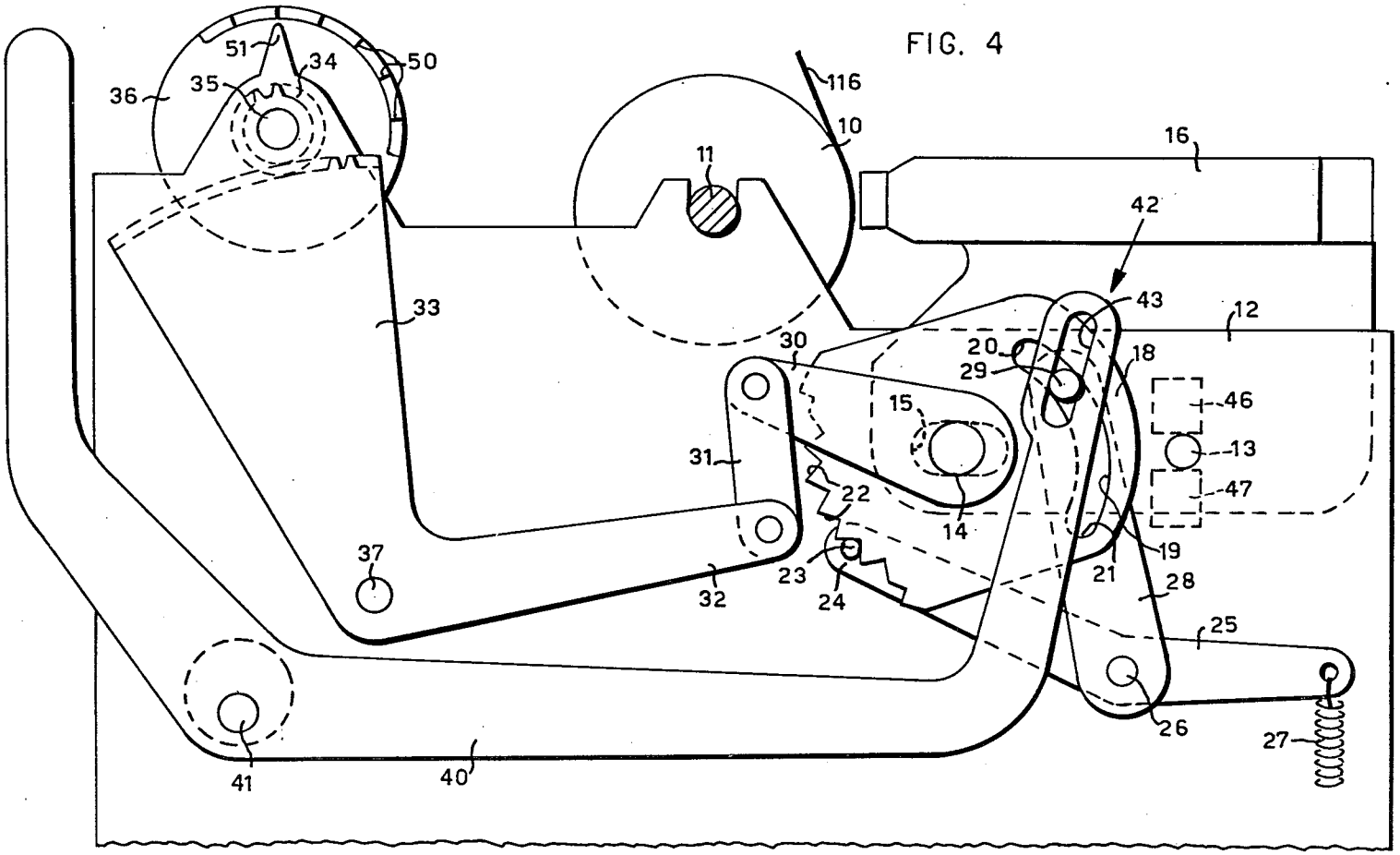
FIG. 4 is a view like that of FIG. 3 but showing additional parts of the arrangement.

Referring to FIG. 1, the arrangement includes a printing head 16 of the wire type which is slidable on two cylindrical guides 13 and 14 parallel to a platen 10. On the platen 10 there is arranged a recording medium 116 on which the head 16 can print (see also FIGS. 2 to 4).

Below the guides 13 and 14, there is arranged a transporting device 122 which comprises a toothed belt 123 stretched between two toothed pulleys 124 and 125, which are mounted rotatably on a frame 120. The pulley 124 is the driving pulley and is connected to a motor 126 fixed below the frame 120 and known per se.

The printing head 16 is provided with a bottom projection 130 to which is fixed one end of a flexible plate or strip 131 disposed substantially parallel to the platen 10. The other end of the plate 131 is fixed to a pair of small vertical plates 133 which are clamped on to the transporting belt 123.

The front guide 13 (FIG. 4) is fixed at its ends to two side plates 12 of the frame 120 and is disposed parallel to the platen 10. The head 16 runs on the guide 13 via rollers 46 and 47 with horizontal axis running in the front to rear direction so that the head 16 is located vertically but can adjust in position to the front or rear (away from or towards the platen 10).

The cylindrical guide or shaft 14, which is also disposed parallel to the platen 10, can rotate and translate parallel to itself in slotted holes 15 formed in the side plates 12. The head 16 slides closely on this guide 14 so that movement of the guide 14 in the slotted holes 15 is communicated to the head 16.

A cam 18 is keyed at the end of the guide 14 and has an arcuate slot 19 of spiral form such that the distance of its profile from the axis of rotation increases steadily linearly from one end 20 to the other end 21. Moreover, in a position diametrically opposite with respect to the slot 19, the cam 18 carries a series of teeth 22 co-operating with a detent stud 23 fixed at one end 24 of a lever 25, which is pivoted on a pin 26 fixed to the side plate 12. To the other end of the lever 25, there is attached a spring 27 which holds the stud 23 against the teeth 22 to prevent accidental rotary movements of the cam 18. A lever 28 on which there is fixed a pin 20 co-operating with the slot 19 of the cam 18 is pivoted on the same pin 26.

A crank 30 keyed on the guide 14 is connected by means of a link 31 to a lever arm 32 integral with a toothed sector 33 pivoted on a pin 37 fixed to the side plate 12. The toothed sector 33 meshes with a gear 34 rotatable on a pin 35 fixed to the side plate 12; a thumb wheel 36 is connected rigidly to the gear 34.

Formed on the wheel 36 are progressively numbered notches 50 which, when they coincide with a pointer 51, indicate the position assumed by the printing head 16 with respect to the platen 10. For example, the notches 50 may be numbered according to the number of copy sheets which can be inserted over the platen 10, for obtaining optimum printing.

A lever 40 is pivoted on a pin 41 and has at one end 42 a rectilinear slot 43 co-operating with the pin 29. When the lever 40 is swung clockwise (FIG. 4), the slot 43 pushes the pin 29 to the right, causing the lever 28 to turn clockwise. The pin 29, in turn, shifts the cam 18 to the right and rigidly with it also the shaft 14, which can slide in the slotted hole 15. In this way, the head 16 is also shifted to the right, inasmuch as it bears on the guide 13 at the front by means of the two cylindrical rollers 46 and 47. This makes it possible to move the head 16 away from the platen 10 by a distance sufficient to enable the sheets to be printed on to be inserted conveniently.

On the other hand, when it is desired to adjust the distance of the head 16 from the platen 10 as a function of the number of copies to be printed, operation is as follows. If starting from the position of minimum spacing, the wheel 36 is rotated anti-clockwise by as many positions as there are copy sheets introduced over platen 10. The gear 34 causes the sector 33 to turn clockwise and this, in turn, swings the cam 18 anti-clockwise.

During this operation, the pin 29 is kept fixed by the slot 43 of the lever 40, as a result of which the swinging cam 18 is compelled to shift the shaft 14, on which it is keyed, to the right by an amount equal to the total variation in the distance of the profile of the slot 19 with respect to the shaft 14. Consequently, the head 16 will also shift by the same amount with respect to the platen 10.

This total variation is sub-divided into partial increments equal to the pitch between two successive teeth 22, to which pitch there may be assigned a value such as to impart to the head 16 movements which are equal to the average thickness of a copy sheet used on the platen 10.

The adjustments of the head 16 and of the guides 13 and 14 with respect to the transporting device 122 cause the plate 131 to bend, but are not transmitted to the belt 123, which is therefore not stressed.

By energising the motor 126 in known manner, the belt 123 is driven by the pulley 124 and the head 16 is thus caused to translate in front of the recording medium 116 parallel to the platen 10.

The plate or strip 131 is sufficiently thick to withstand tensile stress without distorting during the movement of the head 16 from left to right and not to be subject to a peak load during the return movement of the head 16 from right to left. The plate 131 is moreover sufficiently long to cause the distance between the projection 130 of the head 16 and the plates 133 of the belt 123 to be substantially the same even when the head 16 shifts transversely to the belt 123.

What I claim is:

1. In an office machine having a platen, a wire-type printing head movable parallel to the platen along at least one guide, a manually operable means for adjusting the distance between said head and the platen comprising:

a shaft parallel to said guide, said guide engaging said head and being laterally movable along with said head toward and away from said platen, a cam fixed to said shaft and having a cam surface, a manually operated linkage connected to said cam for moving said cam about the axis of said shaft, and means engageable by said surface to shift said cam and said shaft laterally when said cam is moved about said shaft axis.

2. The office machine as set forth in claim 1 wherein said shaft constitutes a second guide for said head, said head slidably engaging said shaft.

3. The office machine of claim 1 wherein said cam surface is formed in a slot on said cam, and said means engageable by said cam surface comprises a pin extending into said slot, said pin being movable with respect to said slot between a first position wherein said head is closely spaced from said platen and a second position wherein said head is spaced further from said platen, said slot increasing in distance from said shaft axis between said first position and said second position.

4. The office machine of claim 3 wherein said pin is mounted on a lever operable to move said pin selectively between said first and second positions.

5. The office machine of claim 4 further comprising a movable transporting means for moving said head along said guide, and a flexible strip attached to said head and to said movable transporting means, said flexible strip extending generally parallel to the path of movement of said transporting device and flexing to accommodate the movement of said head toward and away from said platen.

6. The office machine of claim 5 wherein said transporting device comprises:

a belt extending substantially parallel to said guide, a pair of feed pulleys supporting said belt, attachment means for attaching said strip to said belt.

7. In an office machine having a platen, a wire-type printing head movable parallel to said platen along at least one guide, belt means movable in a path substantially parallel to said platen, and means for adjusting the distance between said head and said platen, the improvement comprising an elongated flexible strip attached to said head and to said belt, said strip extending substantially parallel to said belt and flexing to accommodate the movement of said head toward and away from said platen.

* * * * *